US009494053B2

(12) United States Patent
Orosa

(10) Patent No.: US 9,494,053 B2
(45) Date of Patent: Nov. 15, 2016

(54) DIFFUSER WITH STRUT-INDUCED VORTEX MIXING

(71) Applicant: John A. Orosa, Palm Beach Gardens, FL (US)

(72) Inventor: John A. Orosa, Palm Beach Gardens, FL (US)

(73) Assignee: siemens Aktiengesellschaft, München (DE)

( * ) Notice: Subject to any disclaimer, the term of this patent is extended or adjusted under 35 U.S.C. 154(b) by 576 days.

(21) Appl. No.: 14/033,788

(22) Filed: Sep. 23, 2013

(65) Prior Publication Data

US 2015/0086339 A1 Mar. 26, 2015

(51) Int. Cl.

*F01D 25/30* (2006.01)
*F01D 17/16* (2006.01)
*F01D 17/14* (2006.01)

(52) U.S. Cl.

CPC ..... *F01D 25/30* (2013.01); *F01D 17/143* (2013.01); *F01D 17/16* (2013.01); *F05D 2220/32* (2013.01); *F05D 2240/122* (2013.01); *F05D 2240/127* (2013.01); *F05D 2250/70* (2013.01)

(58) Field of Classification Search

CPC ..... F05D 2240/122; F05D 2240/127
See application file for complete search history.

(56) References Cited

U.S. PATENT DOCUMENTS

| | | | | |
|---|---|---|---|---|
| 5,338,155 | A | 8/1994 | Kreitmeier | |
| 5,941,060 | A | 8/1999 | Marmilic et al. | |
| 6,997,676 | B2 | 2/2006 | Koshoffer | |
| 7,114,911 | B2 | 10/2006 | Martin et al. | |
| 7,444,802 | B2 | 11/2008 | Parry | |
| 7,549,839 | B2 | 6/2009 | Carroll et al. | |
| 8,061,983 | B1 | 11/2011 | Bowers et al. | |
| 2004/0088989 | A1 | 5/2004 | Dowman | |
| 2008/0121301 | A1 | 5/2008 | Norris | |
| 2008/0317587 | A1 | 12/2008 | Lord et al. | |
| 2009/0297334 | A1 | 12/2009 | Norris et al. | |
| 2009/0317238 | A1 | 12/2009 | Wood et al. | |
| 2011/0058939 | A1 | 3/2011 | Orosa et al. | |
| 2011/0232291 | A1 | 9/2011 | Luedke et al. | |
| 2013/0152592 | A1 | 6/2013 | Orosa et al. | |
| 2014/0064955 | A1* | 3/2014 | Senter | F01D 9/042 415/209.3 |
| 2015/0361819 | A1* | 12/2015 | Epstein | F01D 17/12 415/1 |

FOREIGN PATENT DOCUMENTS

| | | | |
|---|---|---|---|
| EP | 2559851 | A1 | 2/2013 |

* cited by examiner

*Primary Examiner* — John K Fristoe, Jr.
*Assistant Examiner* — Jason Davis

(57) ABSTRACT

A gas turbine engine includes inner and outer shrouds forming an annular gas path, and a plurality of struts connecting the inner shroud to the outer shroud. Airfoil shaped shields surround the struts, and each of the shields include a main body having an upstream leading edge defining a chordal axis extending in a downstream axial direction from the leading edge toward a downstream end of the shield. A trailing edge flap is located at the downstream end of each shield, the trailing edge flap including first and second span-wise portions. The first span-wise portion is oriented to direct flow at an angle relative to the chordal axis of the main body and the second span-wise portion is oriented to direct flow in a direction that is at a different angle than the angle of first span-wise portion.

17 Claims, 4 Drawing Sheets

DIFFUSER WITH STRUT-INDUCED VORTEX MIXING

FIELD OF THE INVENTION

The invention relates in general to turbine engines and, more particularly, to exhaust diffusers for turbine engines.

BACKGROUND OF THE INVENTION

Referring to FIG. 1, a turbine engine 10 generally includes a compressor section 12, a combustor section 14, a turbine section 16 and an exhaust section 18. In operation, the compressor section 12 can induct ambient air and can compress it. The compressed air from the compressor section 12 can enter one or more combustors 20 in the combustor section 14. The compressed air can be mixed with the fuel, and the air-fuel mixture can be burned in the combustors 20 to form a hot working gas. The hot gas can be routed to the turbine section 16 where it is expanded through alternating rows of stationary airfoils and rotating airfoils and used to generate power that can drive a rotor 26. The expanded gas exiting the turbine section 16 can be exhausted from the engine 10 via the exhaust section 18.

The exhaust section 18 can be configured as a diffuser 28, which can be a divergent duct formed between an outer shell 30 and a center body or hub 32 and a tail cone 34 supported by support struts 36. The exhaust diffuser 28 can serve to reduce the speed of the exhaust flow and thus increase the pressure difference of the exhaust gas expanding across the last stage of the turbine. In some prior turbine exhaust sections, exhaust diffusion has been achieved by progressively increasing the cross-sectional area of the exhaust duct in the fluid flow direction, thereby expanding the fluid flowing therein, and is typically designed to optimize operation at design operating conditions. Additionally, gas turbine engines are generally designed to provide desirable diffuser inlet conditions at the design point, in which the exhaust flow passing from the turbine section 16 is typically designed to have radially balanced distributions of flow velocity and swirl.

Various changes in the operation of the gas turbine engine may result in less than optimum flow conditions at the diffuser inlet and, in particular, can result in radially distorted flow entering the diffuser. For example, operation at an off-design operating point, e.g., part load operation or an off-design ambient air inlet temperature, may result in a radially non-uniform velocity distribution entering the diffuser. Also, redesigns of an existing engine, such as to increase the output of the engine, may result in less than optimal flow conditions at the diffuser inlet if structure controlling flow into the diffuser is not reconfigured for changes affecting flow conditions through the engine.

SUMMARY OF THE INVENTION

In accordance with an aspect of the invention, a gas turbine engine having a turbine exhaust section is provided. The gas turbine engine comprises a pair of concentrically spaced rings, and a plurality of strut structures extending radially between the rings, interconnecting and supporting the rings. The strut structures are supported downstream of a last row of rotating blades and comprise a main body portion having an elongated chordal dimension in the direction of an axial gas flow through the engine, and define a chordal axis extending in a downstream direction from an upstream end of the main body portion toward a downstream end of the strut structure. A trailing edge flap is located at the downstream end of each main body portion, the trailing edge flap including first and second span-wise portions. The first span-wise portion is oriented to direct flow at an angle relative to the chordal axis of the main body portion and the second span-wise portion is oriented to direct flow in a direction that is at a different angle than the angle of the first span-wise portion.

The first span-wise portion may define a flap angle in a direction to a first side of the chordal axis, and the second span-wise portion may define a flap angle in a direction to a second, opposite side of the chordal axis from the first side.

The direction of the flap angle of the first span-wise portions may alternate relative to circumferentially adjacent first span-wise portions, and the direction of the flap angle of the second span-wise portions may alternate relative to circumferentially adjacent second span-wise portions.

The direction of the flap angle of each of the first span-wise portions may all be oriented in the same direction, and the direction of the flap angle of each of the second span-wise portions may all be oriented in the same direction.

The first span-wise portion may extend from a span-wise intermediate location toward an inner one of the rings along the strut structure and the second span-wise portion may extend from the intermediate location toward an outer one of the rings.

The span-wise intermediate location may be at the mid-span of the main body.

The strut structures may include struts surrounded by an airfoil shaped shield, and the strut structures may be located at an upstream end of an exhaust diffuser for the engine.

The first and second span-wise portions may be movable relative to the main body, and the first span-wise portion may be movable independently of the second span-wise portion.

The strut structure may include a planar divider, lying in an axially and circumferentially extending plane intersecting a span-wise transition between the first and second span-wise portions limiting radial flow between the first and second span-wise portions.

In accordance with another aspect of the invention, a gas turbine engine having an exhaust diffuser is provided. The gas turbine engine comprises an inner shroud and an outer shroud forming an annular gas path, and a plurality of struts connecting the inner shroud to the outer shroud. The struts are located within the gas path downstream of a last row of rotating blades. Airfoil shaped shields surround the struts, and each of the shields comprise a main body having an upstream leading edge defining a chordal axis extending in a downstream axial direction from the leading edge toward a downstream end of the shield. A trailing edge flap is located at the downstream end of each shield, the trailing edge flap including first and second span-wise portions. The first span-wise portion is oriented to direct flow at an angle relative to the chordal axis of the main body and the second span-wise portion is oriented to direct flow in a direction that is at a different angle than the angle of first span-wise portion.

For each shield, the first span-wise portion may define a flap angle in a direction to a first side of the chordal axis, and the second span-wise portion may define a flap angle in a direction to a second, opposite side of the chordal axis from the first side.

The direction of the flap angle of the first span-wise portions may alternate relative to circumferentially adjacent first span-wise portions, and the direction of the flap angle of the second span-wise portions may alternate relative to circumferentially adjacent second span-wise portions.

The direction of the flap angle of each of the first span-wise portions may all be oriented in the same direction, and the direction of the flap angle of each of the second span-wise portions may all be oriented in the same direction.

The first span-wise portion may extend from a span-wise intermediate location toward the inner shroud along the shield and the second span-wise portion may extend from the intermediate location toward the outer shroud.

The span-wise intermediate location may be at the mid-span of the shield.

The first and second span-wise portions may be movable relative to the chordal axis.

Actuators may be connected to the first and second span-wise portions to actuate the first span-wise portion in movement independently of the second span-wise portion.

The strut structure may include a planar divider, lying in an axially and circumferentially extending plane intersecting a span-wise transition between the first and second span-wise portions limiting radial flow and increasing mechanical stiffness between the first and second span-wise portions.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

In accordance with an aspect of an invention, a diffuser design is described to provide an improved diffuser performance by providing increased radial mixing of flow passing through the diffuser, including an improved uniformity of the flow velocity distribution between radially inner and outer regions of the diffuser. In an exemplary application of the diffuser described herein, a common occurrence of a hub-strong velocity profile may be addressed by the present invention by creation of a swirling flow that causes higher velocity flow near the inner boundary (hub) to move outward and lower velocity flow near the outer boundary to move inward, resulting in a mixing of the flow.

Figure 1:
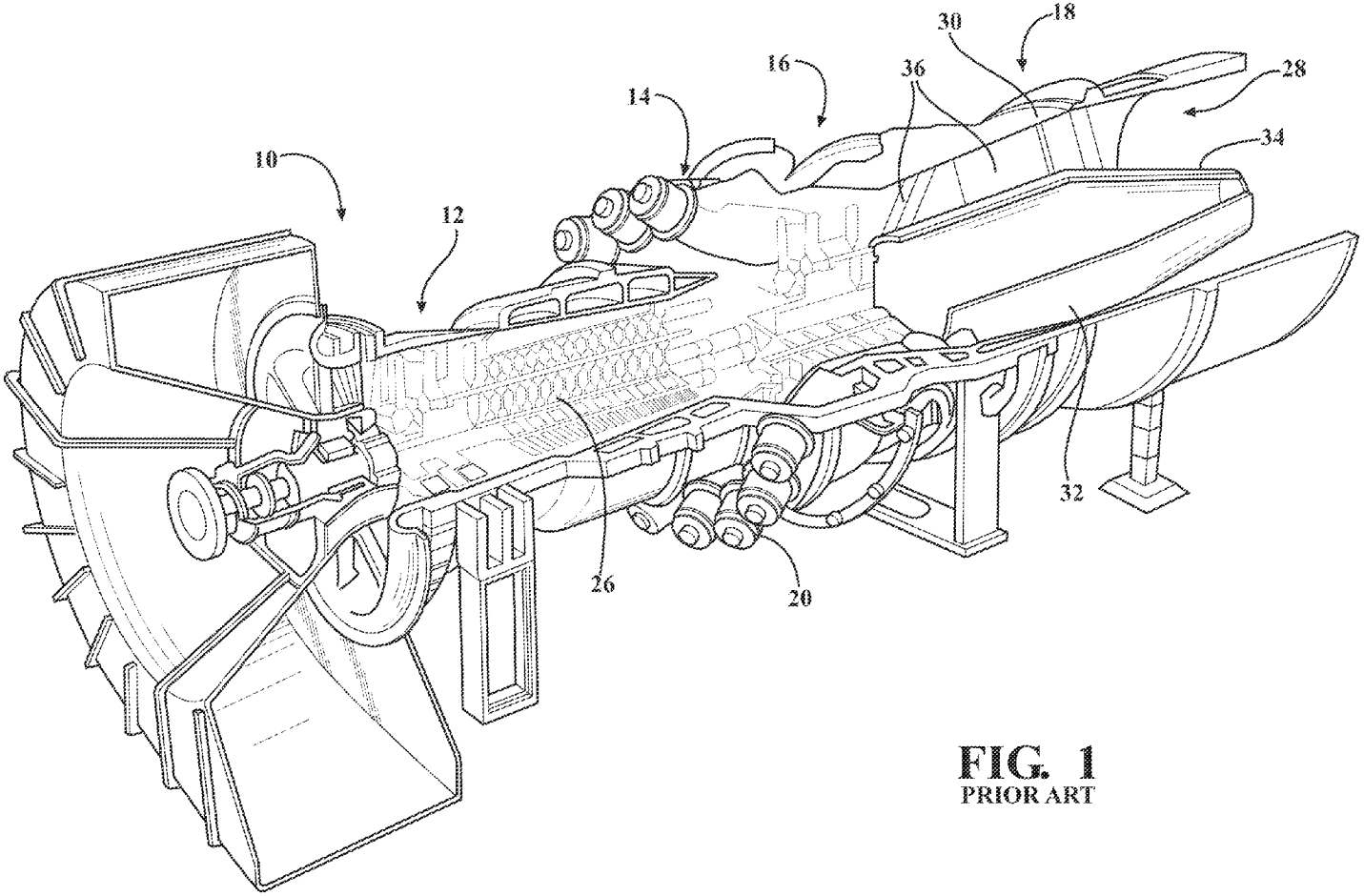
FIG. 1 PRIOR ART
FIG. 1 is a perspective view partially in cross-section of a known turbine engine.
Figure 2:
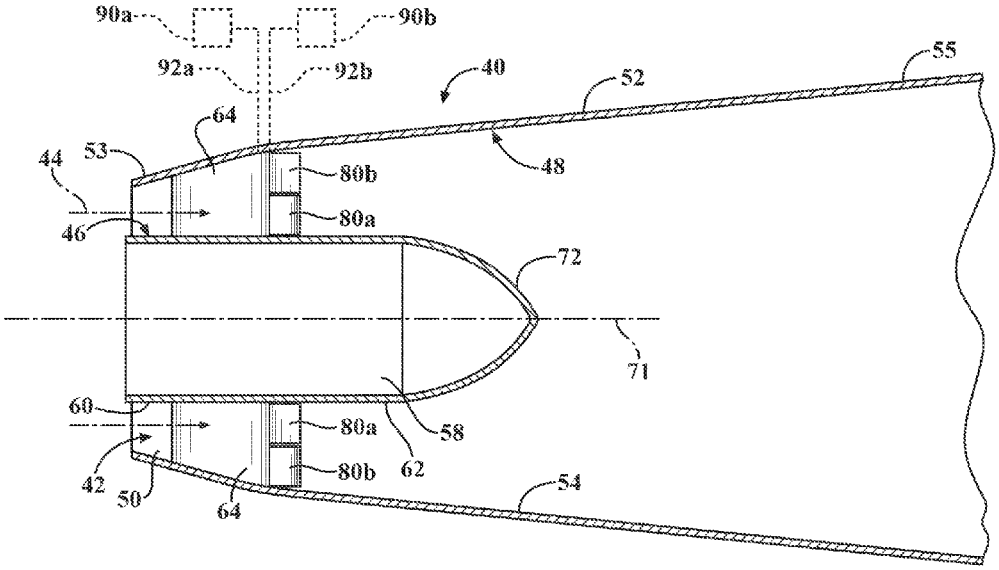
FIG. 2 is a side elevation cross-sectional view of an exhaust diffuser section of a turbine engine configured in accordance with aspects of the invention.

FIG. 2 shows an exhaust section including a portion of an exhaust diffuser 40 of a gas turbine engine configured in accordance with aspects of the invention. The exhaust diffuser 40 is downstream from a last row of rotating blades of a turbine section of the engine, which may correspond to the turbine section 16 of the engine 10 shown in FIG. 1. The exhaust diffuser 40 has an inlet 42 that can receive an exhaust flow or exhaust gases 44 exiting from the turbine section. The exhaust diffuser 40 includes an inner boundary 46, which may comprise an inner ring, and an outer boundary 48, which may comprise an outer ring. The outer boundary 48 is radially spaced from the inner boundary 46 such that a flow path 50 is defined between the inner and outer boundaries 46, 48. The flow path 50 can be generally annular or can have any other suitable configuration.

The outer boundary 48 is shown as comprising a diffuser shell 52 having an inner peripheral surface 54 defining the outer boundary 48 of the flow path 50. The diffuser shell 52 defines the axial length (only a portion of which is shown in FIG. 2) of the exhaust diffuser 40. The axial length extends from an upstream end 53 to a downstream end 55 of the diffuser shell 52.

Figure 3:
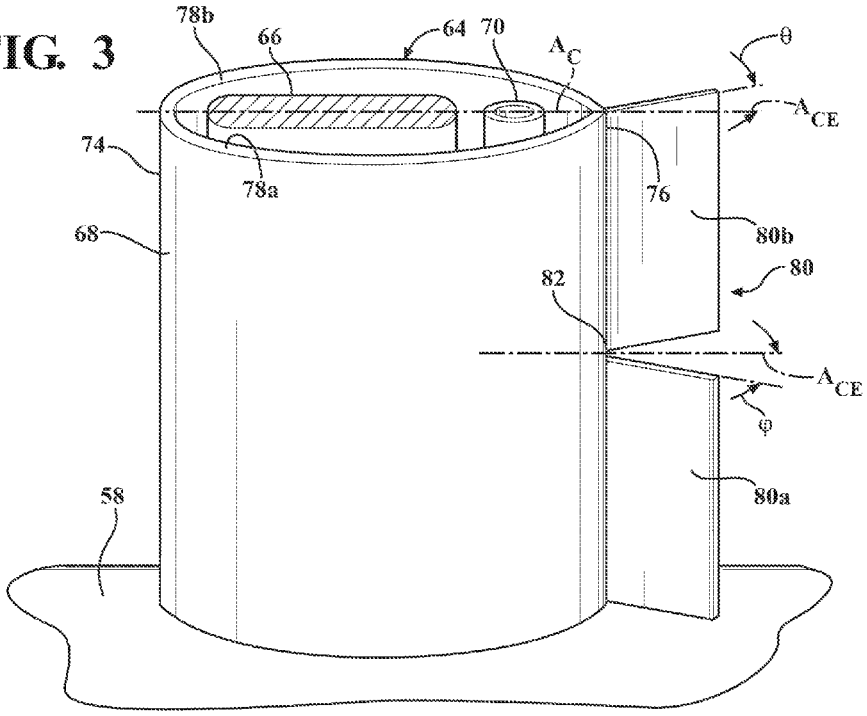
FIG. 3 is an enlarged perspective view of a strut structure illustrating aspects of the invention.

The inner boundary 46 can be defined by a center body, also referred to as a hub 58. The hub 58 may be generally cylindrical and may include an upstream end 60 and a downstream end 62. The terms "upstream" and "downstream" are intended to refer to the general position of these items relative to the direction of fluid flow through the exhaust diffuser section 40. The hub 58 is interconnected and supported to the diffuser shell 52 by a plurality of radially extending strut structures 64, that may comprise a structural strut 66 surrounded by a strut liner or shield 68, as seen in FIG. 3. The strut structures 64 are arranged in circumferential alignment in a row, as is illustrated diagrammatically by strut structures $\mathbf{64}_{A\text{-}F}$ in FIG. 8. One or more of the strut structures 64 may provide a passage for conduits such as, for example, service lines, e.g., an exemplary oil line 70 is illustrated, extending to a bearing housing (not shown) within the hub 58.

Referring to FIG. 2, the inner boundary 46 may also be defined by a tail cone 72. The tail cone 72 has an upstream end attached to the downstream end 62 of the hub 58 in any suitable manner. Preferably, the tail cone 72 tapers from the downstream end 62 of the hub 58 extending in the downstream direction. The hub 58 and the tail cone 72 can be substantially concentric with the diffuser shell 52 and can share a common longitudinal axis 71, corresponding to a central axis for the flow path 50. The inner surface 54 of the diffuser shell 52 is oriented to diverge from the longitudinal axis 71 in the downstream direction, such that at least a portion of the flow path 50 is generally conical.

Referring to FIG. 3, the strut shields 68 each may be formed with an aerodynamic airfoil shape. The illustrated strut shield 68 defines a main body portion and includes a leading edge at an upstream end 74, a trailing edge at a downstream end 76, and opposing sides 78*a*, 78*b* extending in an axial direction, i.e., in the direction of gas flow through the flow path 50, between the upstream and downstream ends 74, 76. A chordal axis $A_C$ is defined by the opposing sides 78*a*, 78*b* extending in the downstream direction from the upstream end 74. The axial direction of the chordal axis $A_C$ may be parallel to the longitudinal axis 71, or may be angled relative to the longitudinal axis 71, as may be dictated by the particular structural and/or flow characteristics of the exhaust section.

In accordance with an aspect of the invention, a trailing edge flap 80 is located at the downstream end 76 of the strut shield 68 and includes first and second span-wise portions comprising a generally planar first flap portion 80*a* and a generally planar second flap portion 80*b*. The first flap portion 80*a* extends from an intermediate location 82 along the radial span of the strut shield 68 toward a radially inner location at or adjacent to the hub 58, and the second flap portion 80*b* extends from the intermediate location 82 toward a radially outer location at or adjacent to the diffuser shell 52. The intermediate location in the illustrated configuration is at the mid-span of the strut shield 68, however, it may be understood that an intermediate location defining the boundary between the flap portions 80*a*, 80*b* may be selected at other span-wise locations.

The first and second flap portions 80*a*, 80*b* are independently oriented to modify the flow of exhaust gases passing into and through the diffuser 40. In particular, an exhaust flow entering the diffuser with a non-uniform radial velocity distribution may be modified by the trailing edge flap 80 to increase the uniformity of the velocity distribution, and the first and second flap portions 80*a*, 80*b* may be positioned to provide radial mixing of the flow to reduce variation of the velocity profile across the span of the flow path 50.

The orientation of the first flap portion 80*a* is illustrated in FIG. 3 by a flap angle $\phi$ of the first flap portion 80*a* relative to an extension of the chordal axis $A_C$, as depicted by an extension line $A_{CE}$ parallel to the chordal axis $A_C$ at the downstream end 76 of the strut shield 68. Similarly, the orientation of the second flap portion 80*b* is illustrated in FIG. 3 by a flap angle $\theta$ of the second flap portion 80*b* relative to an extension of the chordal axis $A_C$, as depicted by an extension line $A_{CE}$ parallel to the chordal axis $A_C$ at the downstream end 76 of the strut shield 68, wherein the angle $\theta$ of the second flap portion 80*b* depicts a circumferential orientation of the second flap portion 80*b* that is different than the circumferential orientation of the first flap portion 80*a*. That is, the second flap portion 80*b* is oriented to direct the gas flow in the flow path 50 in a different circumferential direction than the flow direction defined by the first flap portion 80*a*. For example, in the illustrated configuration, the second flap portion 80*b* is directed to an opposite side of the chordal axis $A_C$ than the first flap portion 80*a*.

Figure 4:
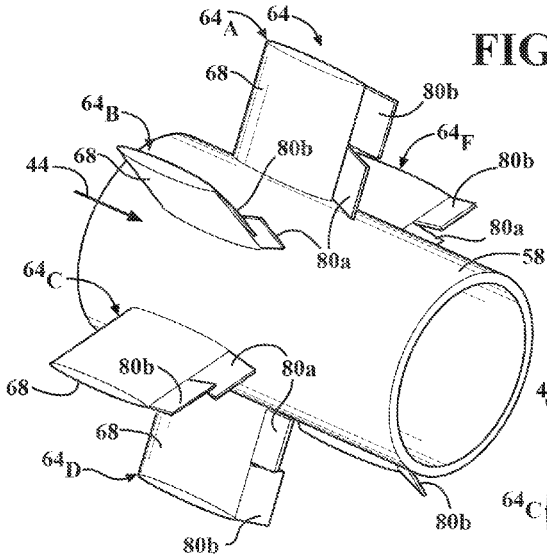
FIG. 4 is a perspective view illustrating a first configuration of a row of strut structures.
Figure 8:
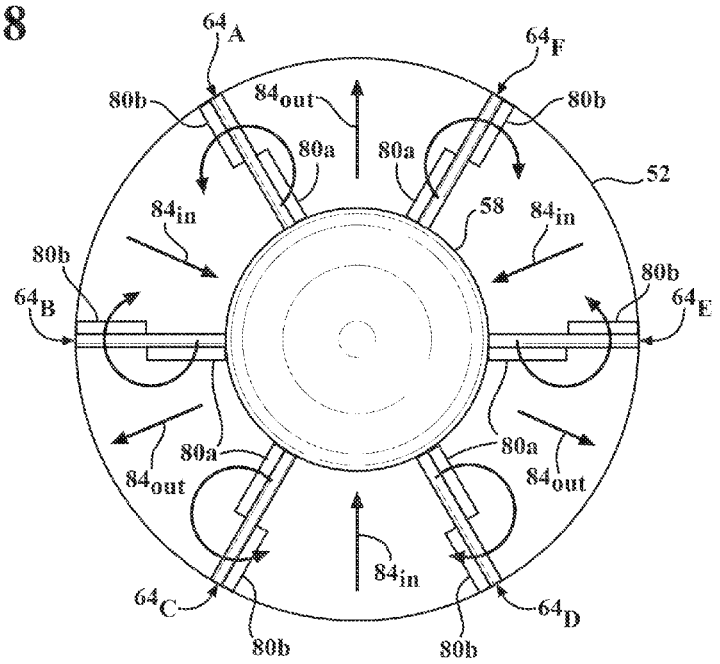
FIG. 8 is a diagrammatic end view, in a front to rear direction of the diffuser, illustrating a flow pattern produced in accordance with an aspect of the invention.

Referring to FIG. 4, a configuration of the strut structures 64 illustrates an aspect of the invention in which the circumferential direction of the flap angle $\theta$ of the first flap portions 80*a* alternates, i.e., to opposite sides of the chordal axis $A_C$, relative to circumferentially adjacent first flap portions 80*a*, as may be seen by comparing the position of the first flap portions 80*a* of the successive strut structures $\mathbf{64}_A$-$\mathbf{64}_F$ (see also FIG. 8). Similarly, the circumferential direction of the flap angle $\phi$ of the second flap portions 80*b*, which are oriented opposite to the first flap portions 80*a*, alternates relative to circumferentially adjacent second flap portions 80*b*, as may be seen by comparing the position of the second flap portions 80*b* of the successive strut structures $\mathbf{64}_A$-$\mathbf{64}_F$ (see also FIG. 8).

Referring to FIG. 8, the arrangement of the first and second flaps 80*a*, 80*b* for the strut structure configuration of FIG. 4 is designed to provide a swirling flow, i.e., counter-rotating vortices, downstream of the strut structures 64 where the strut structures 64 induce radial outward movement, depicted by flow arrows $\mathbf{84}_{Out}$, and radial inward movement, depicted by flow arrows $\mathbf{84}_{in}$, resulting in a mixing of the flow and causing the velocity profile to become more uniform. In the event of a hub strong flow, for example, with a higher flow velocity at the hub 58 than at the diffuser shell 52, the flow mixing provided by the flap portions 80*a*, 80*b*, moves lower velocity flow inward from the diffuser shell 52 and higher velocity flow outward from the hub 52 to reduce velocity variations within the flow passing through the diffuser 40. In particular, the described trailing edge flap 80 can alter a hub strong flow to provide a stronger outer diameter flow profile, with improved attachment to the diffuser shell 52, and increased outward mixing of the strong flow in the region adjacent to the hub 58.

In the configuration of FIG. 4, when viewed in a downstream direction from the front of the engine, as in FIG. 8, the flaps 80*a*, 80*b* angled in the counterclockwise direction may be referred to as having a positive angle, and the flaps 80*a*, 80*b* angled in the clockwise direction may be referred to as having a negative angle. This convention for positive and negative angles is made with reference to an engine having a rotor that rotates in a counterclockwise direction, as viewed from the front of the engine.

Figure 5:
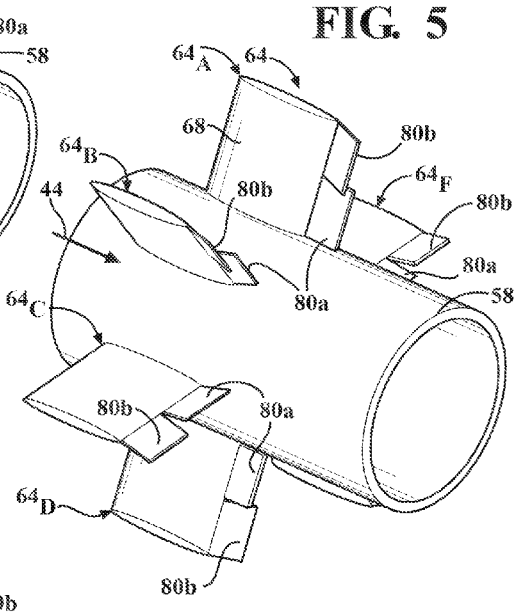
FIG. 5 is a perspective view illustrating a second configuration of a row of strut structures.

FIG. 5 illustrates an alternative configuration in which the circumferential direction of the flap angle $\phi$ for the first flap portions 80*a* are all oriented in the same (positive) direction and at the same angle relative to the chordal axis $A_C$, and the flap angle $\theta$ of the second flap portions 80*b* are all oriented in the same (negative) direction and at the same angle relative to the chordal axis $A_C$. In the illustrated configuration, the first flap portions 80*a* are angled to one side of the chordal axis $A_C$, and the second flap portions 80*b* are angled to the opposite side of the chordal axis $A_C$. While it is believed that the configuration of FIG. 5 may provide less radial mixing than the configuration described for FIG. 4, it may be understood that different mixing effects may be desirable depending on the characteristics of the flow exiting the turbine section of the engine.

Further, it may be understood that, although the above description references an exemplary hub-strong flow of the exhaust gas, a configuration of the flap portions 80*a*, 80*b* may be provided to address other flow conditions, such as a weaker flow of the exhaust gas adjacent to the hub 58.

The trailing edge flap 80 forms a substantial portion of the overall length of the axial extent of the combined strut shield 68 and trailing edge flap 80, from the leading edge at the upstream end 74 of the strut shield 68 to a trailing edge of the trailing edge flap 80. For example, the trailing edge flap 80 may be about 20% to 40% of the overall length and, more preferably, may be about 25% to 30% of the overall length.

It should be noted that the angles $\phi$, $\theta$ of the flap portions 80*a*, 80*b* may have the same value in opposite directions relative to the chordal axis $A_C$, or may have different values. Specifically, since the spacing between the circumferentially adjacent strut structures 64 increases in the radial outward direction, the desired swirl conditions may require positioning the second flap portions 80*b* at a greater angle $\theta$ than the angle $\phi$ of the first flap portions 80*a*. Further, it should be understood that the flap portions 80*a*, 80*b* may both extend to the same side of the chordal axis $A_C$, but with the positions of the flap portions 80*a*, 80*b* defining different values for the angles $\phi$, $\theta$.

Also, the flap portions 80*a*, 80*b* may be formed along only portions of the inner and outer spans of the downstream end 76 of the strut shield 68. For example, within the scope of the present invention, each of the flap portions 80*a* and 80*b* may extend radially from the intermediate location 82 a portion of the distance toward the hub 58 and diffuser shell 52, respectively.

Figure 6:
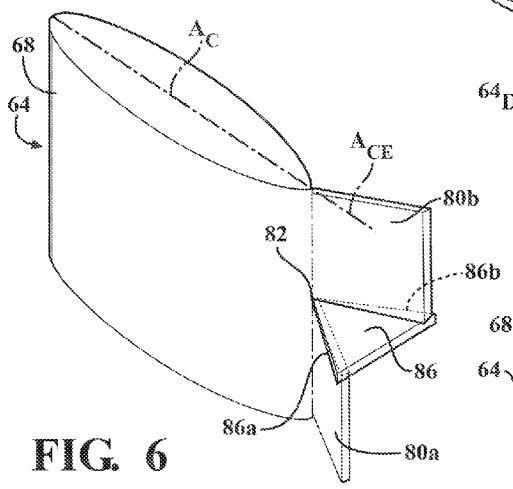
FIG. 6 is a perspective view showing an optional modification to the trailing edge flap of the strut structure.

FIG. 6 illustrates an optional modification to the trailing edge flap 80. A splitter plate 86 may be provided at the intermediate location 82 between the first and second flap portions 80*a*, 80*b*. The splitter plate 86 is a generally planar divider, lying in an axially and circumferentially extending plane to limit radial flow and increase mechanical stiffness between the first and second flap portions 80*a*, 80*b*. The plane of the splitter plate 86 extends perpendicular to the span-wise or radial direction of the strut shield 68. In addition, the splitter plate 86 may be formed with a triangular configuration having outer edges 86*a*, 86*b* generally matching the angular location of the flap portions 80*a*, 80*b*, and is preferably attached to the flap portions 80*a*, 80*b*, such as by a weld connection, providing increased rigidity of the trailing edge flap 80.

Figure 7:
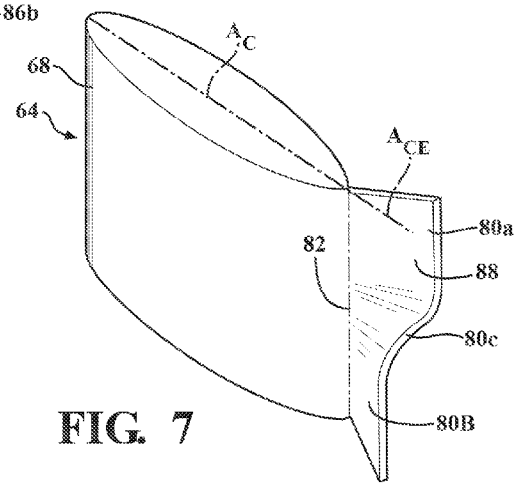
FIG. 7 is a perspective view showing an alternative configuration for the trailing edge flap of the strut structure.

FIG. 7 illustrates an alternative configuration of the trailing edge flap 80. The trailing edge flap 80 may be formed of a continuous strip of material 88 forming both the first flap portion 80*a* and the second flap portion 80*b*. In particular, the strip of material 88 may be formed with a bent transition area 80*c* at the intermediate location 82, defining a smooth transition from the angle defined by the first flap portion 80*a* to the angle defined by the second flap portion 80*b*.

Figure 9:
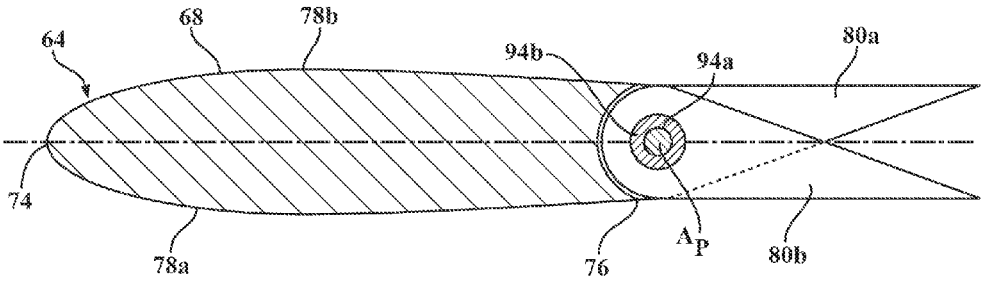
FIG. 9 is a plan view, radially inward, showing an optional modification of the trailing edge of the strut structure.

Referring to FIG. 9, an optional modification to the trailing edge flap 80 is illustrated in which the flap portions 80*a*, 80*b* are movable relative to the strut shield 68. In the illustrated embodiment, the flap portions 80*a*, 80*b* are supported for pivotal movement about a pivot axis A. Each of the flap portions 80*a*, 80*b* may be actuated for pivotal movement by a respective actuator, as depicted by actuators 90*a*, 90*b*, diagrammatically illustrated in FIG. 1. The actuators 90*a*, 90*b* may be connected to the flap portions 80*a*, 80*b* by a pivot linkage 92*a*, 92*b* and may incorporate a known actuator and linkage structure, such as is shown in U.S. Pat. No. 6,792,758 illustrating an actuator for a single actuated tail section, which patent is incorporated herein by reference in its entirety. The flap portions 80*a*, 80*b* may be supported by, for example, respective concentric pivot rods 94*a*, 94*b* extending radially through the downstream end 76 of the strut shield 68 for pivotal movement about the common pivot axis $A_P$, or they may be supported by pivot elements having separate pivot axes. It may be noted that the first flap portions 80*a* may all be linked for simultaneous movement by a single actuator, and the second flap portions 80*b* may all be linked for simultaneous movement by a single actuator, and a linkage between the respective flap portions 80, 80*b* may be constructed in a manner similar to that shown in U.S. Pat. No. 6,792,758.

The movable flap portions 80*a*, 80*b* may be operated in response to changing operating conditions of the engine to provide an efficient mixing of exhaust gases flowing into the diffuser 40. For example, the flap portions 80*a*, 80*b* may be located at initial positions that provide an efficient expansion of the exhaust gases through the diffuser 40 during a base load operation, and the flap portions 80*a*, 80*b* may be relocated to second positions that provide an efficient expansion of the exhaust gases through the diffuser 40 during a part load operation of the engine or during an off-design ambient air inlet temperature condition.

The configuration of the strut structure 64 shown in FIG. 9 depicts the flap portions 80*a*, 80*b* formed as a continuation of the contour formed by the sides 78*a*, 78*b* of the strut shield 68. It should also be noted that strut structures 64 having the flap portions 80*a*, 80*b* permanently fixed in position, such as is described with reference to FIGS. 3-5, may be formed with a similar continuous contour between the strut shield 68 and the flap portions 80*a*, 80*b*.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A gas turbine engine having a turbine exhaust section comprising:

a pair of concentrically spaced rings;

a plurality of strut structures extending radially between the rings, interconnecting and supporting the rings;

the plurality of strut structures supported downstream of a last row of rotating blades and comprising a main body portion having an elongated chordal dimension in the direction of an axial gas flow through the engine and defining a chordal axis extending in a downstream direction from an upstream end of the main body portion toward a downstream end of the strut structure; and a trailing edge flap located at the downstream end of each main body portion, the trailing edge flap including first and second span-wise portions, the first span-wise portion oriented to direct flow at an angle relative to the chordal axis of the main body portion and the second span-wise portion oriented to direct flow in a direction that is at a different angle than the angle of the first span-wise portion, wherein the entirety of the first span-wise portion defines a flap angle in a direction to a first side of the chordal axis, and wherein the first and second span-wise portions are oriented independently of each other such that the entirety of the second span-wise portion defines a flap angle in a direction to a second, opposite side of the chordal axis from the first side.

2. The gas turbine engine of claim 1, wherein the direction of the flap angle of the first span-wise portions alternates relative to circumferentially adjacent first span-wise portions, and the direction of the flap angle of the second span-wise portions alternates relative to circumferentially adjacent second span-wise portions.

3. The gas turbine engine of claim 1, wherein the direction of the flap angle of each of the first span-wise portions are all oriented in the same direction, and the direction of the flap angle of each of the second span-wise portions are all oriented in the same direction.

4. The gas turbine engine of claim 1, wherein the first span-wise portion extends from a span-wise intermediate location toward an inner one of the rings along the plurality of strut structures and the second span-wise portion extends from the intermediate location toward an outer one of the rings.

5. The gas turbine engine of claim 4, wherein the span-wise intermediate location is at the mid-span of the main body.

6. The gas turbine engine of claim 1, wherein the plurality of strut structures include struts surrounded by an airfoil shaped shield, and the plurality of strut structures are located at an upstream end of an exhaust diffuser for the engine.

7. The gas turbine engine of claim 1, wherein the first and second span-wise portions are movable relative to the main body, and the first span-wise portion is movable independently of the second span-wise portion.

8. The gas turbine engine of claim 1, including a planar divider, lying in an axially and circumferentially extending plane intersecting a span-wise transition between the first and second span-wise portions limiting radial flow between the first and second span-wise portions.

9. An exhaust diffuser for a gas turbine engine, comprising:

an inner shroud and an outer shroud forming an annular gas path;

a plurality of struts connecting the inner shroud to the outer shroud and located within the gas path downstream of a last row of rotating blades;

airfoil shaped shields surrounding the struts, each of the shields comprise a main body having an upstream leading edge defining a chordal axis extending in a downstream axial direction from the leading edge toward a downstream end of the shield; and a trailing edge flap located at the downstream end of each shield, the trailing edge flap including first and second span-wise portions, the first span-wise portion oriented to direct flow at an angle relative to the chordal axis of the main body and the second span-wise portion oriented to direct flow in a direction that is at a different angle than the angle of first span-wise portion, wherein for each shield, the entirety of the first span-wise portion defines a flap angle in a direction to a first side of the chordal axis, wherein the first and second span-wise portions are oriented independently of each other such that the entirety of the second span-wise portion defines a flap angle in a direction to a second, opposite side of the chordal axis from the first side.

10. The exhaust diffuser of claim 9, wherein the direction of the flap angle of the first span-wise portions alternates relative to circumferentially adjacent first span-wise portions, and the direction of the flap angle of the second span-wise portions alternates relative to circumferentially adjacent second span-wise portions.

11. The exhaust diffuser of claim 9, wherein the direction of the flap angle of each of the first span-wise portions are all oriented in the same direction, and the direction of the flap angle of each of the second span-wise portions are all oriented in the same direction.

12. The exhaust diffuser of claim 9, wherein the first span-wise portion extends from a span-wise intermediate location toward the inner shroud along the shield and the second span-wise portion extends from the intermediate location toward the outer shroud.

13. The exhaust diffuser of claim 12, wherein the span-wise intermediate location is at the mid-span of the shield.

14. The exhaust diffuser of claim 9, wherein the first and second span-wise portions are movable relative to the chordal axis.

15. The exhaust diffuser of claim 14, including actuators connected to the first and second span-wise portions to actuate the first span-wise portion in movement independently of the second span-wise portion.

16. The exhaust diffuser of claim 9, including a planar divider, lying in an axially and circumferentially extending plane intersecting a span-wise transition between the first and second span-wise portions limiting radial flow between the first and second span-wise portions.

17. An exhaust diffuser for a gas turbine engine, comprising:

an inner shroud and an outer shroud forming an annular gas path;

a plurality of struts connecting the inner shroud to the outer shroud and located within the gas path downstream of a last row of rotating blades;

airfoil shaped shields surrounding the struts, each of the shields comprise a main body having an upstream leading edge defining a chordal axis extending in a downstream axial direction from the leading edge toward a downstream end of the shield; and a trailing edge flap located at the downstream end of each shield, the trailing edge flap including first and second span-wise portions, the first span-wise portion oriented to direct flow at an angle relative to the chordal axis of the main body and the second span-wise portion oriented to direct flow in a direction that is at a different angle than the angle of first span-wise portion, wherein for each shield, the first span-wise portion defines a flap angle in a direction to a first side of the chordal axis, and the second span-wise portion defines a flap angle in a direction to a second, opposite side of the chordal axis from the first side, and wherein the direction of the flap angle of the first span-wise portions alternates relative to circumferentially adjacent first span-wise portions, and the direction of the flap angle of the second span-wise portions alternates relative to circumferentially adjacent second span-wise portions.

* * * * *